US010556322B2

(12) United States Patent
Chandekar et al.

(10) Patent No.: US 10,556,322 B2
(45) Date of Patent: Feb. 11, 2020

(54) ABRASIVE FLAP DISC INCLUDING WEARABLE BACKING PLATE

(71) Applicants: SAINT-GOBAIN ABRASIVES, INC., Worcester, MA (US); SAINT-GOBAIN ABRASIFS, Conflans-Sainte-Honorine (FR)

(72) Inventors: Amol Nalraj Chandekar, Chennai (IN); Udayan Paramban, Chennai (IN); Surendra Kumar, Sonbhadra (IN)

(73) Assignees: SAINT-GOBAIN ABRASIVES, Inc., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 84 days.

(21) Appl. No.: 15/807,699

(22) Filed: Nov. 9, 2017

(65) Prior Publication Data

US 2018/0133867 A1 May 17, 2018

(30) Foreign Application Priority Data

Nov. 15, 2016 (IN) ..... 201641038891

(51) Int. Cl.

| | |
|---|---|
| ***B24D 13/04*** | (2006.01) |
| ***B24D 9/08*** | (2006.01) |
| ***B24D 3/00*** | (2006.01) |
| ***B24D 13/16*** | (2006.01) |

(52) U.S. Cl.
CPC ..... *B24D 9/08* (2013.01); *B24D 3/001* (2013.01); *B24D 13/16* (2013.01)

(58) Field of Classification Search
CPC ..... B24D 13/04; B24D 13/16
USPC ..... 451/466, 465, 464, 490, 529
See application file for complete search history.

(56) References Cited

U.S. PATENT DOCUMENTS

| | | | | |
|---|---|---|---|---|
| 5,752,876 | A | 5/1998 | Hettes | |
| 5,951,389 | A * | 9/1999 | Hettes | B24B 45/006 403/343 |
| 6,582,289 | B1 | 6/2003 | Eisenberg | |
| 6,786,812 | B2 * | 9/2004 | Stuckenholz | B24D 9/08 451/463 |
| 6,863,596 | B2 | 3/2005 | Fritz et al. | |
| 6,945,863 | B1 | 9/2005 | Hettes | |
| 8,246,425 | B2 | 8/2012 | Schudel | |
| 8,585,470 | B2 * | 11/2013 | Farber | B24B 23/02 451/466 |

(Continued)

FOREIGN PATENT DOCUMENTS

| | | | |
|---|---|---|---|
| WO | 2002096603 | A1 | 12/2002 |
| WO | 2012052090 | A1 | 4/2012 |
| WO | 2018093629 | A1 | 5/2018 |

OTHER PUBLICATIONS

International Search Report and Written Opinion for PCT/US2017/060569, dated Feb. 20, 2018, 12 pages.

*Primary Examiner* — Robert A Rose
(74) *Attorney, Agent, or Firm* — Abel Schillinger, LLP; Joseph Sullivan

(57) ABSTRACT

This invention relates to abrasive flap discs that include wearable backing plates and methods of making and using such abrasive flap discs and wearable backing plates. The claimed articles, processes, and systems related to the use and manufacturing of such abrasive articles are improved in performance and cost effectiveness.

19 Claims, 5 Drawing Sheets

(56) References Cited

U.S. PATENT DOCUMENTS

| | | | |
|---|---|---|---|
| 2002/0177391 | A1 | 11/2002 | Fritz et al. |
| 2005/0170764 | A1 | 8/2005 | Shin |
| 2012/0071073 | A1 | 3/2012 | Farber |

* cited by examiner

ABRASIVE FLAP DISC INCLUDING WEARABLE BACKING PLATE

CROSS-REFERENCE TO RELATED APPLICATION

This application claims priority under 35 U.S.C. § 119(a) to, and incorporates herein by reference in its entirety for all purposes, Indian application 201641038891, filed Nov. 15, 2016, entitled "ABRASIVE FLAP DISC INCLUDING WEARABLE BACKING PLATE," to Amol Nalraj CHANDEKAR et al. and which is assigned to the current assignee hereof.

FIELD OF THE INVENTION

The present disclosure generally relates to wearable back plates, abrasive flap discs including same, and methods of producing such wearable back plates and flap discs. In particular, the present disclosure relates to wearable back plates for flap discs that can include abrasive particles, nonabrasive particles, filler particles, or a combination thereof dispersed in a polymeric resin.

BACKGROUND

Abrasive flap discs are typically used in high pressure grinding applications, such as angle grinding of metals and ceramics. Conventional abrasive flap discs typically employ backing plates that, while strong and durable, typically do not wear down along with the abrasive flaps that are supported by the backing plate. Therefore, when the tips of the abrasive flaps along the outer periphery of the flap disc are worn down, the entire flap disc must usually be discarded, even though a majority of the body of the flaps are still capable of further use.

Various approaches have been attempted to solve the problems related to the lack of a wearable backing plate for a flap disc but all suffer from certain drawbacks.

Therefore, there continues to be a demand for improved flap discs that include wearable backing plates.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

Figure 1:
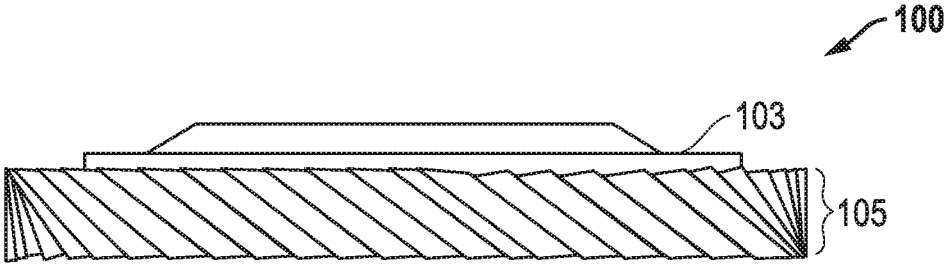
FIG. 1 is an illustration of an embodiment of a flap disc including a wearable backing plate.

Referring now to the Figures. FIG. 1 shows an illustration of an embodiment of a flap disc 100 including a wearable backing plate 103. The flap disc comprises a wearable backing plate 103 and a plurality of abrasive flaps 105 disposed along the periphery of the backing plate.

Figure 2:
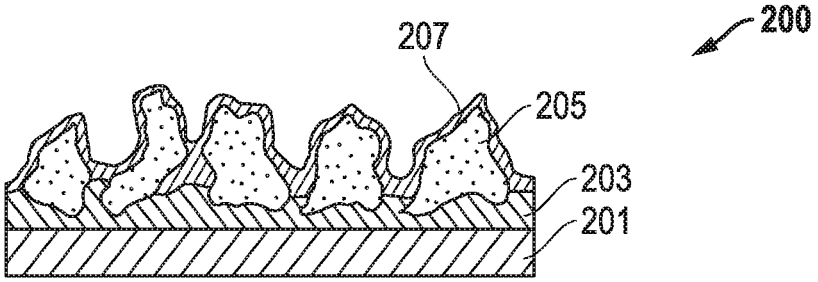
FIG. 2 is an illustration of a cross-sectional view of an embodiment of a coated abrasive flap.

FIG. 2 shows an illustration of a cross section of an abrasive flap 200 embodiment that includes a binder 203 composition disposed on a backing material 201. Abrasive particles 205 are disposed on or dispersed in the binder (typically called a "make coat" when the abrasive particles are disposed on the binder, typically called a "slurry coat" when the abrasive particles are dispersed in the binder). A size coat 207 composition is disposed over the make coat and the abrasive particles. An optional supersize coat (not shown) composition can be disposed over the size coat.

Figure 3:
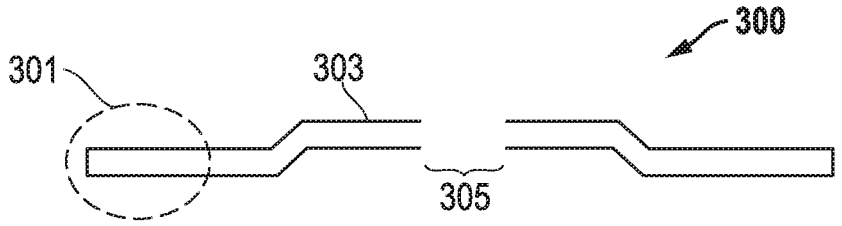
FIG. 3 is an illustration of a cross-sectional view of an embodiment of a wearable backing plate.

FIG. 3 shows an illustration of a cross-sectional view of an embodiment of a wearable backing plate 300. The wearable backing plate 300 can comprise a central portion 303 and a distal portion 301. The central portion can include a central opening 305. The central portion and the distal portion can be separated by a transition portion 307.

Figure 4:
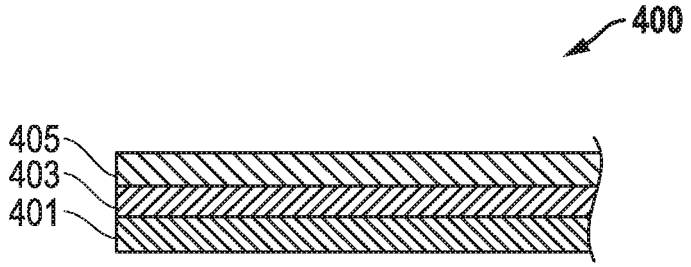
FIG. 4 is an illustration of a cross-sectional view of an embodiment of a wearable backing plate comprising three layers.

FIG. 4 is an illustration of a cross-sectional view of a distal portion of an embodiment of a wearable backing plate 400 comprising a wearable polymer layer 403 disposed between a first reinforcing layer 401 and a second reinforcing layer 405.

Figure 5:
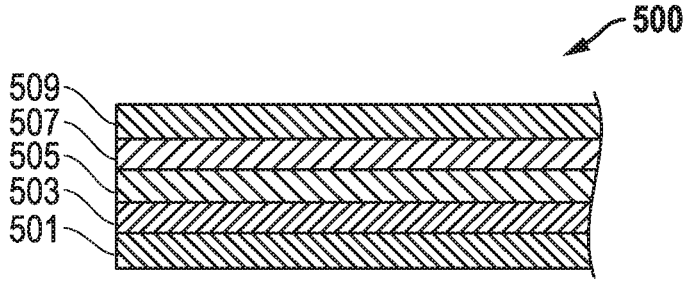
FIG. 5 is an illustration of a cross-sectional view of an embodiment of a wearable backing plate comprising five layers.

FIG. 5 is an illustration of a cross-sectional view of a distal portion of another embodiment of a wearable backing plate 500 comprising a first wearable polymer layer 503 disposed between a first reinforcing layer 501 and a second reinforcing layer 505. A second wearable polymer layer 507 is disposed on the second reinforcing layer 505. A third reinforcing layer 509 is disposed on the second wearable polymer layer 507.

Figure 6:
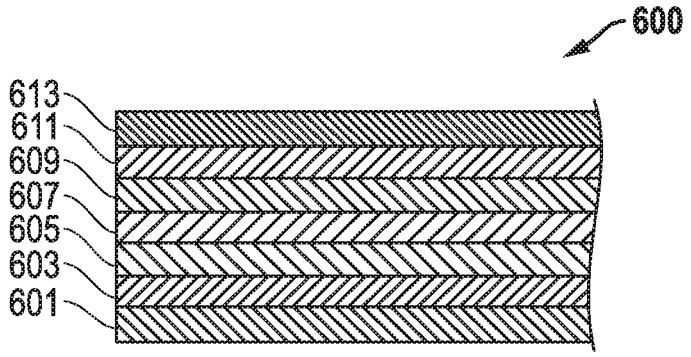
FIG. 6 is an illustration of a cross-sectional view of an embodiment of a wearable backing plate comprising seven layers.

FIG. 6 is an illustration of a cross-sectional view of a distal portion of another embodiment of a wearable backing plate 600 comprising a first wearable polymer layer 603 disposed between a first reinforcing layer 601 and a second reinforcing layer 605. A second wearable polymer layer 607 is disposed on the second reinforcing layer 609. A third reinforcing layer 609 is disposed on the second wearable polymer layer 607. A third wearable polymer layer 611 is disposed on the third reinforcing layer 609. A fourth reinforcing layer 613 is disposed on the third wearable polymer layer 611.

Figure 7:
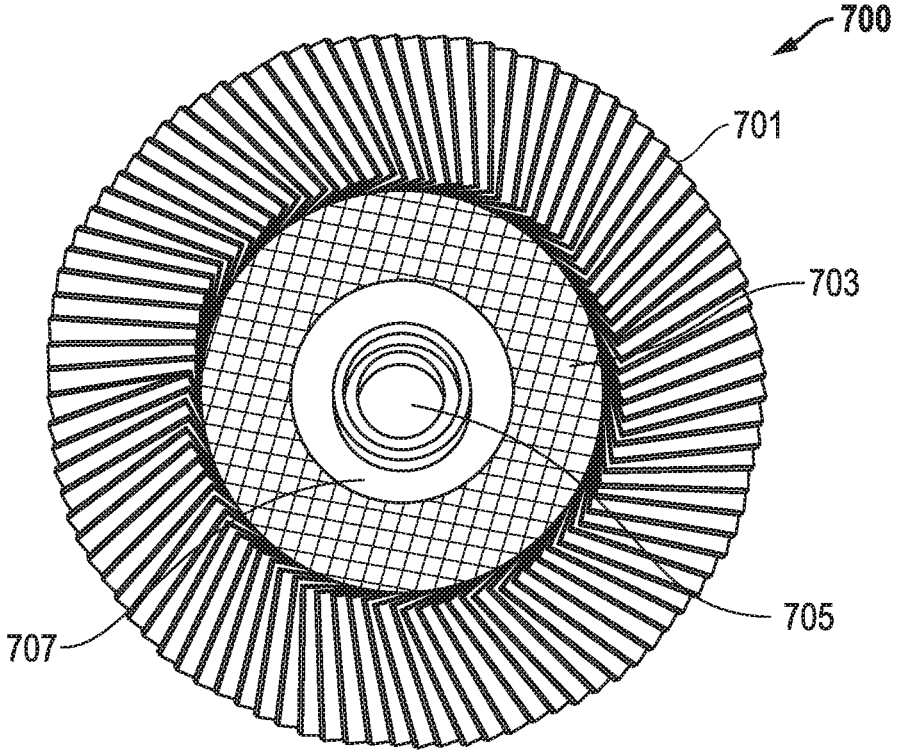
FIG. 7 is an illustration of an embodiment of a flap disc including a wearable backing plate.

FIG. 7 is an illustration (top view) of an embodiment of a flap disc 700 including a wearable backing plate 703. A plurality of abrasive flaps 701 is disposed about a periphery of the wearable backing plate 703. The wearable backing plate includes an optional attachment component 707 (e.g., ring, collar, etc.) disposed in a central opening 705 (also called a "hole" herein) located in the center of the wearable backing plate.

Figure 8:
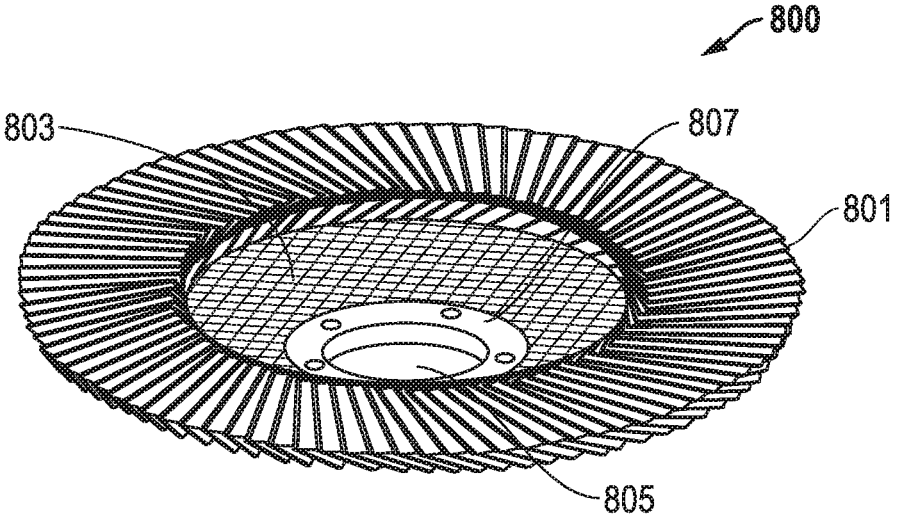
FIG. 8 is an illustration of an embodiment of a flap disc including a wearable backing plate.

FIG. 8 is an illustrative photograph (perspective view) of the same flap disc embodiment shown in FIG. 7, but viewed from an angle. The flap disc 800 includes a wearable backing plate 803, a plurality of abrasive flaps 801 disposed about a periphery of the wearable backing plate 803, an optional attachment component 807 disposed in a central opening 805 located in the center of the wearable backing plate.

Figure 9:
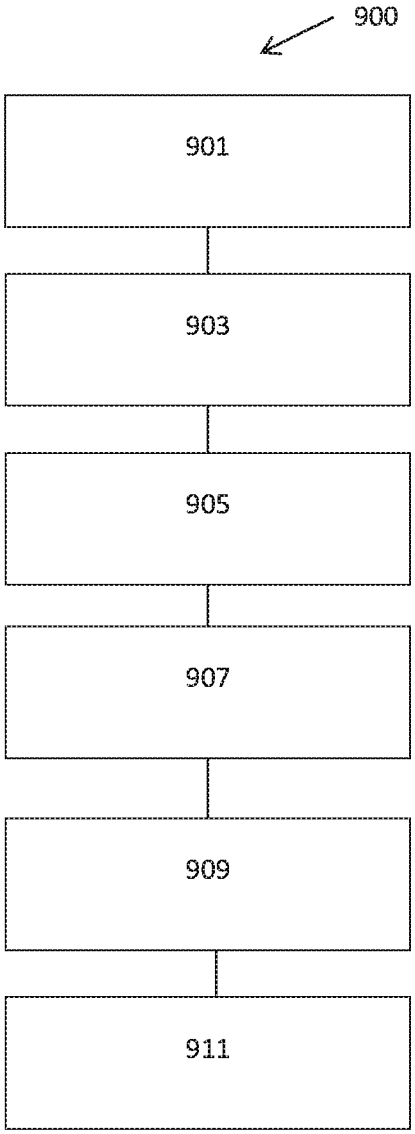
FIG. 9 is an illustration of a flowchart of an embodiment of a method of making a flap disc including a wearable backing plate.

FIG. 9 is an illustration of a flowchart of an embodiment of a method of making a wearable backing plate. Step 901 includes mixing together of ingredients to form a precursor composition. In an embodiment, the ingredients of the precursor composition can comprise a polymeric resin, and abrasive particles, nonabrasive particles, filler particles, or a combination thereof. Step 903 includes disposing a first fiber reinforcement layer into a mold. Step 905 includes disposing a portion of the precursor composition over the first fiber reinforcement layer in the mold. Step 907 includes disposing a second fiber reinforcement layer over the precursor composition in the mold. Step 909 includes pressing the mold. Step 911 includes curing the precursor composition (in the mold) to form the wearable polymeric backing plate. In an embodiment, Step 909 and 911 can occur at the same time. In another embodiment, steps 905 and 907 can be repeated to add additional fiber reinforcement layers and precursor composition prior to pressing in the mold.

Figure 10:
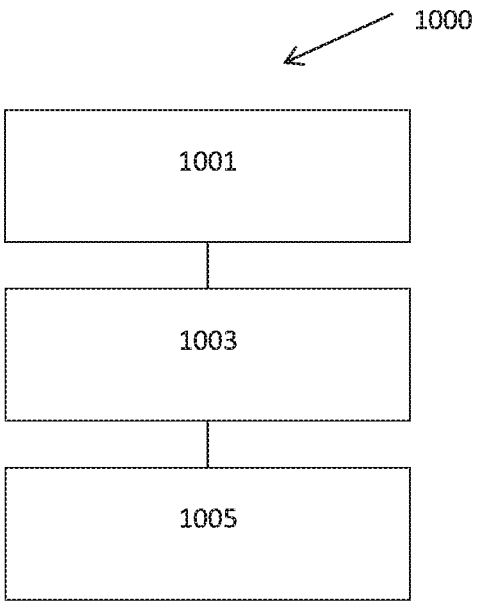
FIG. 10 is an illustration of a flowchart of an embodiment of a method of making a wearable backing plate.

FIG. 10 is an illustration of a flowchart of a method 1000 of making a flap disc according to an embodiment. Step 1001 includes preparing a wearable backing plate according to the steps of the method described above in FIG. 9. Step 1003 includes disposing an adhesive on a periphery of the wearable backing plate. Step 1005 includes disposing abrasive flaps on the adhesive located on the periphery of the wearable backing plate to form an abrasive flap disc. In another embodiment, curing the adhesive can be included as an additional step 1007.

Wearable Backing Plate

In an embodiment, a wearable backing plate can comprise a plurality of layers. The layers can be the same as or different from each other. The layers can be arranged in various beneficial stacking configurations and arrangements. In an embodiment, multiples of the same type of layer can be stacked on top of each other. In another embodiment, different types of layers, or multiples of different types of layers, can be stacked on tope of each other in an alternating pattern.

The wearable backing plate can comprise a beneficial number of layers. The number of layers can be fixed or variable. The wearable backing plate can comprise a single layer or a plurality of layers. In an embodiment, the wearable backing plate has a single layer. In another embodiment, the wearable backing plate has at least 2 layers, such as at least 3 layers, at least 4 layers, at least 5 layers, at least 6 layers, or at least 7 layers. In another embodiment, the number of layers of the wearable backing plate can be at most 25 layers, such as at most 24 layers, at most 23 layers, at most 22 layers, at most 21 layers, at most 20 layers, at most 19 layers, or at most 18 layers. The number of layers of the wearable backing plate can be within a range comprising any pair of the previous upper and lower limits. In a particular embodiment, the number of layers of the wearable backing plate is in the range of 1 to 25 layers, such as 1 to 15 layers, 1 to 9 layers, 1 to 7 layers, or such as 3 to 25 layers, 3 to 15 layers, 3 to 9 layers, or 3 to 7 layers. In a particular embodiment, the wearable backing plate can comprise 3 to 7 layers, such as 7 layers, 5 layers, or even 3 layers. In another specific embodiment, the wearable backing plate can comprise 1 to 3 layers, such a 3 layers, 2 layers, or even 1 layer.

In an embodiment, the wearable backing plate can comprise a wearable polymeric layer, a reinforcement layer, or a combination thereof. In an embodiment, a wearable backing plate comprises a wearable polymeric layer; a first reinforcing layer, and a second reinforcing layer, wherein the first wearable polymeric layer is disposed between the first reinforcing layer and the second reinforcing layer. In another embodiment, the wearable backing plate can further comprise a second wearable polymeric layer disposed on the second reinforcing layer, and a third reinforcing layer disposed on the second wearable polymeric layer. In another embodiment, the wearable backing plate can further a third wearable polymeric layer disposed on the third reinforcing layer, and a fourth reinforcing layer disposed on the third wearable polymeric layer.

As stated previously, the layers of the wearable backing plate can be the same or different, in an embodiment, the second reinforcing layer can be the same as the first reinforcing layer. In another embodiment, the second reinforcing layer can be different than the first reinforcing layer. In an embodiment, the third reinforcing layer can be the same as the first reinforcing layer or the second reinforcing layer. In another embodiment, the third reinforcing layer can be different than the first reinforcing layer or the second reinforcing layer. In an embodiment, the second wearable polymeric layer can be the same as the second wearable polymeric layer. In another embodiment, the second wearable polymeric layer can be different than the second wearable polymeric layer. In an embodiment, the fourth reinforcing layer can be the same as the first reinforcing layer, the second reinforcing layer, or the third reinforcing layer. In another embodiment, the fourth reinforcing layer can be different than the first reinforcing layer, the second reinforcing layer, or the third reinforcing layer. In an embodiment, the third wearable polymeric layer can be the same as the first wearable polymeric layer or the second wearable polymeric layer. In another embodiment, the third wearable polymeric layer can be different than the first wearable polymeric layer or the second wearable polymeric layer.

Wearable Polymeric Layer

In an embodiment, a wearable polymeric layer can comprise a polymeric resin, and abrasive particles, nonabrasive particles, filler particles, or a combination thereof dispersed in the polymeric resin. In a specific embodiment, a wearable backing plate comprises abrasive particles dispersed in a polymeric resin. In another specific embodiment, a wearable backing plate comprises nonabrasive particles dispersed in a polymeric resin. In a specific embodiment, a wearable backing plate comprises a combination of abrasive particles and filler particles dispersed in a polymeric resin. In another specific embodiment, a wearable backing plate comprises a combination of nonabrasive particles and filler particles dispersed in a polymeric resin. In another specific embodiment, a wearable backing plate comprises a combination of abrasive particles, nonabrasive particles, and filler particles dispersed in a polymeric resin.

Abrasive Particles

As used herein, an "abrasive particle" refers to a particle having a Mohs hardness of 9 or more. Abrasive particles can include essentially single phase materials, whether organic or inorganic, or composite particulate materials, such as aggregates or agglomerates. In an embodiment, an abrasive particle can comprise one of alumina (including fused, sintered, ceramic, or sol gel), zirconia, silicon carbide, silicon nitride, boron nitride, diamond, co-fused alumina zirconia, titanium diboride, boron carbide, alumina nitride, a combination thereof, or a blend thereof. In a specific embodiment, the abrasive particle comprises alumina.

In an embodiment, the abrasive particles can have an average particle size ($D_{50}$) not greater than 4000 micron, such as not greater than 2000 micron, such as not greater than 1500 micron, not greater than 1000 micron, not greater than 750 micron, or not greater than 500 micron. In another embodiment, the abrasive particle can have an average size of at least 0.1 micron, at least 1 micron, at least 5 micron, at least 10 micron, at least 25 micron, at least 45 micron, at least 50 micron, at least 75 micron, or at least 100 micron. The average particle size can be within a range comprising any pair of the previous upper and lower limits. In another embodiment, the average abrasive particles size from about 0.1 microns to about 2000 microns. The particle size of the abrasive particles is typically specified to be the longest dimension of the abrasive particle. Generally, there is a range distribution of particle sizes. In some instances, the particle size distribution is tightly controlled. In a specific embodiment, the abrasive particle size is 40 grit.

The amount of abrasive particles present in a wearable polymeric layer can vary. In an embodiment, the amount of abrasive particles is not greater than 95 wt %, such as not greater than 92.5 wt %, such as not greater than 90 wt %, not greater than 87.5 wt %, or not greater than 85 wt %. In another embodiment, the amount of abrasive particles is at least 50 wt %, such as at least 52.5 wt %, at least 55 wt %, at least 57.5 wt %, at least 60. wt %, at least 62.5 wt %, or at least 65 wt %. The amount of abrasive particles can be within a range comprising any pair of the previous upper and lower limits. In an embodiment, the amount of abrasive particles can be from about 50 wt % to about 95 wt %, such as about 55 wt % to 92.5 wt %, or about 60 wt % to 90 wt %.

Nonabrasive Particles

As used herein, a "nonabrasive particle" refers to a particle having a Mohs hardness of less than 9. Nonabrasive particles can include essentially single phase materials, whether organic or inorganic, or composite particulate materials, such as aggregates or agglomerates. In an embodiment, a nonabrasive particle can comprise one of lithium, talc, graphite, gypsum, calcite, fluorite, copper, tin, iron, nickel, zirconium, quartz, silica, ceria, flint, emery, garnet, a combination thereof, or a blend thereof. In a specific embodiment, the nonabrasive particle comprises emery.

In an embodiment, the nonabrasive particles can have an average particle size ($D_{50}$) not greater than 4000 micron, such as not greater than 2000 micron, such as not greater than 1500 micron, not greater than 1000 micron, not greater than 750 micron, or not greater than 500 micron. In another embodiment, the nonabrasive particle can have an average size of at least 0.1 micron, at least 1 micron, at least 5 micron, at least 10 micron, at least 25 micron, at least 45 micron, at least 50 micron, at least 75 micron, or at least 100 micron. The average particle size can be within a range comprising any pair of the previous upper and lower limits. In another embodiment, the average nonabrasive particles size from about 0.1 microns to about 2000 microns. The particle size of the nonabrasive particles is typically specified to be the longest dimension of the nonabrasive particle. Generally, there is a range distribution of particle sizes. In some instances, the particle size distribution is tightly controlled. In a specific embodiment, the nonabrasive particle size is 60 grit.

The amount of nonabrasive particles present in a wearable polymeric layer can vary. In an embodiment, the amount of nonabrasive particles is not greater than 95 wt %, such as not greater than 92.5 wt %, such as not greater than 90 wt %, not greater than 87.5 wt %, or not greater than 85 wt %. In another embodiment, the amount of nonabrasive particles is at least 50 wt %, such as at least 52.5 wt %, at least 55 wt %, at least 57.5 wt %, at least 60. wt %, at least 62.5 wt %, or at least 65 wt %. The amount of nonabrasive particles can be within a range comprising any pair of the previous upper and lower limits. In an embodiment, the amount of nonabrasive particles can be from about 50 wt % to about 95 wt %, such as about 55 wt % to 92.5 wt %, or about 60 wt % to 90 wt %.

Filler Particles

In an embodiment, filler particles can comprise one of cryolite, lithopone, iron pyrite, calcium carbonate, sodium carbonate, aluminum fluoride, iron oxide, barium sulfate, calcium sulfate, aluminum sulfate, calcium inosilicate (CaSiO3, a.k.a., wollastonite), cenosphere, clay, polymer modified clay, a combination thereof, or a blend thereof.

The amount of filler particles present in a wearable polymeric layer can vary. In an embodiment, the wearable polymeric layer can be free of filler particles. In another embodiment, the wearable polymeric layer can comprise filler particles. In an embodiment, the amount of filler particles is not greater than 70 wt %, such as not greater than 65 wt %, such as not greater than 60 wt %, not greater than 55 wt %, not greater than 50 wt %, not greater than 45 wt %, not greater than 40 wt %, not greater than 35 wt %, or not greater than 30 wt %. In another embodiment, the amount of filler particles is at least 0 wt %, such as at least 0.5 wt %, at least 1 wt %, at least 3 wt %, at least 5 wt %, at least 7 wt %, or at least 10 wt %. The amount of filler particles can be within a range comprising any pair of the previous upper and lower limits. In an embodiment, the amount of filler particles can be from about 0 wt % to about 70 wt %, such as about 0.5 wt % to 70 wt %, about 1 wt % to 60 wt %, about 3 wt % to 50 wt %, or about 5 wt % to 30 wt %.

Particle Shapes

The abrasive particles, the nonabrasive particles, or the filler particles can have a particular shape or combination of shapes. Exemplary shapes include a rod, a triangle, a tetrahedron, a pyramid, a cone, a cube, a solid sphere, a hollow sphere, or the like. Alternatively, the abrasive particles, the nonabrasive particles, or the filler particles can be randomly shaped (e.g., crushed).

Polymeric Resin

As stated above the wearable backing plate comprises a polymeric composition. The wearable backing plate can be described in terms of the polymeric composition when cured, partially cured, or fully cured. The polymeric composition can be formed of a single polymer or a blend of polymers. The polymeric composition can comprise a phenolic polymer, a resorcinol polymer, a melamine polymer, a urea polymer, or combinations thereof. The phenolic polymer, melamine polymer, or urea polymer can comprise a single prepolymer resin or a blend of resins. Phenolic polymers can comprise phenol formaldehyde resole resins, novolac resins, or a combination thereof. Resole resins are generally made using alkali hydroxides with a formaldehyde to phenol ratio of greater than or equal to 1. On the other hand, novolac resins have a formaldehyde to phenol molar ratio of less than one. In an embodiment, the polymeric composition comprises a phenolic resole resin. In another embodiment, the first polymeric composition comprises a mixture of a plurality of phenolic resole resins. In an embodiment, the polymeric composition can comprise from two to five phenolic resole resins. In a specific embodiment, the polymeric composition comprises a mixture of a first phenolic resole resin and a second phenolic resole resin. In another embodiment, the polymeric composition comprises a blend of a novolac resin and a resole resin.

The amount of polymeric resin present in a wearable polymeric layer can vary. In an embodiment, the amount of polymeric resin is not greater than 30 wt %, such as not greater than 28 wt %, such as not greater than 26 wt %, not greater than 24 wt %, not greater than 22 wt %, not greater than 20 wt %, not greater than 18 wt %, or not greater than 16 wt %. In another embodiment, the amount of polymeric resin is at least 1 wt %, such as at least 2 wt %, at least 3 wt %, at least 4 wt %, at least 5 wt %, or at least 6 wt %. The amount of polymeric resin can be within a range comprising any pair of the previous upper and lower limits. In an embodiment, the amount of polymeric resin can be from about 1 wt % to about 30 wt %, such as about 2 wt % to 28 wt %, or about 3 wt % to 26 wt %.

Resole and novolac resins can be classified by a number of features, such as the formaldehyde to phenol ratio (F/P ratio), number average molecular weight, and weight average molecular weight. In an embodiment, a resole resin can comprise a number avg. mol. wt. in a range of 100-500, such as 200-400, such as 200-300, such as 200-250, such as 200-225. In an embodiment, a resole resin can comprise a weight avg. mol. wt. in a range of 300-600, such as 300-500, such as 300-400, such as 325-375. In an embodiment, a novolac resin can comprise a number avg. mol. wt. in a range of 600-1200, such as 700-1100, such as 800-1000. In an embodiment, a novolac resin can comprise a weight avg. mol. wt. in a range of 2000 to 5000, such as 2000-4000, such as 2000-3500. In another embodiment, a novolac resin can comprise a number avg. mol. wt. greater than 900, such as greater than 925 or greater than 950. In an embodiment, a novolac resin can comprise a weight avg. mol. wt. greater than 2500, such as greater than 2750, greater than 3000.

Reinforcing Fabric

In an embodiment, a reinforcing layer comprises a fabric. In an embodiment, the fabric is a woven fabric, a nonwoven fabric, a mesh, or a combination thereof. In an embodiment, a fabric can comprise organic fibers, inorganic fibers, or a combination thereof. In an embodiment, organic fibers can comprise natural fibers, synthetic fibers, a mixture of natural fibers, a mixtures of synthetic fibers, or a mixture of a natural and a synthetic fibers. In an embodiment, natural fibers can comprise cellulose fibers, cotton fibers, sisal fibers, hemp fibers, jute fibers, banana fibers, bamboo fibers, coconut fibers, paper fibers, or combinations thereof. In an embodiment, synthetic fibers can comprise polyester fibers (e.g., polyethylene terephthalate), nylon fibers (e.g., hexamethylene adipamide, polycaprolactam), polypropylene fibers, acrylonitrile fibers (i.e., acrylic), rayon fibers, cellulose acetate fibers, polyvinylidene chloride-vinyl chloride copolymer fibers, or vinyl chloride-acrylonitrile copolymer fibers. In an embodiment, inorganic fibers can comprise glass fibers, metal fibers, ceramic fibers, cermet fibers, or a combination thereof. In an embodiment, the fabric comprises a woven fiberglass mesh.

The fabric can be partially to fully impregnated with a polymeric composition. The fabric can also be partially to completely engulfed or submerged within a polymeric composition. The polymeric composition used to impregnate or engulf the fabric can be the same as or different than the polymeric composition of the wearable polymeric layer described above. In an embodiment, the fabric is impregnated and/or engulfed with a polymeric composition that is the same as described above with respect to the polymeric composition of the wearable polymer layer.

The fabric can have a beneficial mesh density. In an embodiment, the fabric comprises a mesh density of at least 2.5×2.5. In an embodiment, the fabric comprises a mesh density of not greater than 13×13. The mesh density can be within a range comprising any pair of the previous upper and lower limits. In an embodiment, the mesh density can be at least 4×4, such as 5×5, 6×6, 7×7, 8×8, 9×9, or 10×10. In a particular embodiment, the mesh density is 5×5. In another specific embodiment, the mesh density is 8×8.

The fabric and have a particular mass per unit area, such as g/m2 (GSM), commonly called the "weight" of the fabric. In an embodiment, the weight of the fabric can be not less than 50 GSM, not less than 100 GSM, not less than 150 GSM, not less than 200 GSM, not less than 250 GSM, or not less than 300 GSM. In another embodiment, the weight of the fabric can be not greater than 1000 GSM, not greater than 900 GSM, not greater than 800 GSM, not greater than 700 GSM, or not greater than 600 GSM. The amount of weight of the fabric can be within a range comprising any pair of the previous upper and lower limits. In a particular embodiment, the amount of weight of the fabric can be in a range of not less than 50 GSM to not greater than 1000 GSM, such as not less than 100 GSM to not greater than 900 GSM, not less than 150 GSM to not greater than 800 GSM, such as not less than 200 GSM to not greater than 700 GSM. In a particular embodiment, the fabric can comprise a weight in a range of not less than 150 GSM to not greater than 550 GSM, such as not less than 200 GSM to not greater than 450 GSM, such as not less than 300 GSM to not greater than 400 GSM.

Making a Wearable Backing Plate

A wearable backing plate can be made by mixing together the ingredients to form a precursor composition (also called herein a bond system composition or bond system). The precursor composition can be aged if desired. Aging time can vary from 2 hr. to 24 hr. In a specific embodiment, aging time can be from 4-6 hr. The precursor composition can be sieved if desired. Sieving is optional, but can be beneficial to break up or remove agglomerated grains larger than a desired size. The precursor composition is ready for addition into a mold.

A reinforcing layer (such as a glass fiber sheet or glass fiber disc) can be placed into the mold. A portion (also called a fraction herein) of the bond composition is introduced into the mold over the reinforcing layer to form an uncured wearable polymeric layer. The amount of precursor composition can be divided up into a specific number of fractions based on the desired number of reinforcing layers and wearable polymeric layers for the wearable backing plate. For instance, for a wearable backing plate having five total layers (i.e., three reinforcing layers and two wearable polymeric layers), the precursor composition will be divided into two fractions. A reinforcing layer can be placed on the uncured wearable polymeric layer and the steps repeated until the desired number of layers is present. In an alternate embodiment, multiple numbers of reinforcing layers can be placed together on an uncured wearable polymeric layer. In another embodiment, the fractions of precursor composition can be disposed into the mold in unequal amounts to form thicker or thinner layers as desired. In an embodiment, a final reinforcing layer (e.g., a glass fiber sheet or disc) is placed into the mold on top of the stack of previously disposed layers. In an alternate embodiment, no final reinforcing layer is placed into the mold.

In an embodiment, pressure is applied to compress the structure of stacked reinforcing layers and uncured wearable polymeric layers. The pressure can be applied at a desired intensity and/or duration to achieve a desired thickness for the wearable backing plate. The compression step can be accomplished under a constant or variable pressure.

The uncured polymeric layers are then cured in the mold to form a wearable backing plate. Curing can be conducted in a single step or multiple steps. Curing can be accomplished by free-radical reaction, anionic polymerization, cationic polymerization, coordinated polymerization, or combinations thereof. If desired, curing can include exposure to a radiant light source or a heat source, such as a heating tunnel or oven, including a multi stage oven, or the like. Alternative heating sources can include exposure to infrared radiation lamps, or the like. Alternatively curing can proceed at ambient conditions.

The completed wearable backing plate can be used to form an abrasive article, such as a wearable flap disc.

Wearable Baking Plate

The completed wearable backing plate can be characterized according to volume percent (vol %) of abrasive particles, vol % of nonabrasive particles, vol % of bond composition (i.e., the cured wearable polymeric composition), the vol % of porosity, or a combination thereof. In an embodiment, a wearable backing plate can comprise a beneficial overall vol % of abrasive particles, a vol % of nonabrasive particles, a vol % of bond composition, a vol % of porosity, or a combination thereof.

In an embodiment the amount of abrasive particles present in a wearable backing plate can vary. In an embodiment, the amount of abrasive particles is not greater than 70 vol %, such as not greater than 65 vol %, such as not greater than 60 vol %, not greater than 55 vol %, not greater than 50 vol %, or not greater than 45 vol %. In another embodiment, the amount of abrasive particles is at least 35 vol %, such as at least 36 vol %, at least 37 vol %, at least 38 vol %, at least 39 vol %, at least 40 vol %, at least 41 vol %, at least 42 vol %, at least 43 vol %, at least 44 vol %, or at least 45 vol %. The amount of abrasive particles can be within a range comprising any pair of the previous upper and lower limits. In an embodiment, the amount of abrasive particles can be from about 35 vol % to about 70 vol %, such as about 40 vol % to 65 vol %, or about 45 vol % to 60 vol %.

In an embodiment the amount of nonabrasive particles present in a wearable backing plate can vary. In an embodiment, the amount of nonabrasive particles is not greater than 70 vol %, such as not greater than 65 vol %, such as not greater than 60 vol %, not greater than 55 vol %, not greater than 50 vol %, or not greater than 45 vol %. In another embodiment, the amount of nonabrasive particles is at least 35 vol %, such as at least 36 vol %, at least 37 vol %, at least 38 vol %, at least 39 vol %, at least 40 vol %, at least 41 vol %, at least 42 vol %, at least 43 vol %, at least 44 vol %, or at least 45 vol %. The amount of nonabrasive particles can be within a range comprising any pair of the previous upper and lower limits. In an embodiment, the amount of nonabrasive particles can be from about 35 vol % to about 70 vol %, such as about 40 vol % to 65 vol %, or about 45 vol % to 60 vol %.

In an embodiment the amount of bond composition present in a wearable backing plate can vary. In an embodiment, the amount of bond composition is not greater than 60 vol %, such as not greater than 55 vol %, such as not greater than 50 vol %, or not greater than 45 vol %. In another embodiment, the amount of bond composition is at least 1 vol %, such as at least 3 vol %, at least 5 vol %, at least 7 vol %, at least 10 vol %, at least 12 vol %, at least 14 vol %, or at least 15 vol %. The amount of bond composition can be within a range comprising any pair of the previous upper and lower limits. In an embodiment, the amount of bond composition can be from about 1 vol % to about 60 vol %, such as about 5 vol % to 50 vol %, or about 7 vol % to 45 vol %.

In an embodiment the amount of porosity present in a wearable backing plate can vary. In an embodiment, the wearable backing plate can have very little to no porosity (0 vol %). In another embodiment, the wearable backing plate can comprise a beneficial porosity. In an embodiment, the amount of porosity is not greater than 55 vol %, such as not greater than 50 vol %, such as not greater than 40 vol %, or not greater than 35 vol %. In another embodiment, the amount of porosity is at least 0 vol %, such as at least 1 vol %, at least 3 vol %, at least 5 vol %, at least 7 vol %, or at least 10 vol %. The amount of porosity can be within a range comprising any pair of the previous upper and lower limits. In an embodiment, the amount of porosity can be from about 0 vol % to about 55 vol %, such as about 1 vol % to 55 vol %, or about 0 vol % to 50 vol %, or about 1 vol % to 50 vol %.

Wearable Abrasive Flap Disc

A wearable flap disc can be prepared by disposing an adhesive on a periphery of the wearable backing plate and then disposing abrasive flaps on the adhesive located on the periphery of the wearable backing plate to form a wearable abrasive flap disc.

A wearable abrasive flap disc as described herein can posses many beneficial properties, including a minimum burst speed, a flexural stiffness, a flexural strength, a ratio of the weight of the polymeric resin of the wearable backing plate ($Weight_{backingplateresin}$) to a total weight of the flap disc ($Weight_{flapdisc}$), a ratio of a total weight of the wearable backing plate ($Weight_{backingplate}$) to a total weight ($Weight_{flapdisc}$) of the flap disc, or a combination thereof.

In an embodiment, the wearable abrasive flap disc can comprise a beneficial minimum burst speed. In an embodiment, the burst speed is at least 15,000 rpm, such as at least 16,000 rpm, at least 18,000 rpm, at least 20,000 rpm, at least 22,000 rpm, at least 24,000 rpm, at least 26,000 rpm, or at least 30,000 rpm.

In an embodiment, the wearable abrasive flap disc can comprise a beneficial minimum flexural stiffness. In an embodiment, the flexural stiffness is at least 700 MPa, such as at least 720 MPa, at least 740 MPa, or at least 760 MPa.

Wearable Backing Plate

In an embodiment, the wearable backing plate can comprise a beneficial ratio of the total weight of the polymeric resin of the wearable backing plate ($Weight_{backingplateresin}$) to a total weight of the flap disc ($Weight_{flapdisc}$). In an embodiment, the ratio of $Weight_{backingplateresin}$:$Weight_{flapdisc}$ is not less than 1:500, such as about 1:400, about 1:300, about 1:200, about 1:100, about 1:50, about 1:25, or about 1:20. In an embodiment, $Weight_{backingplateresin}$:$Weight_{flapdisc}$ is at least 1:15, such as about 1:12, about 1:11, about 1:10, about 1:9, about 1:8, or about 1:7. The ratio can be within a range comprising any pair of the previous upper and lower limits. In an embodiment, the ratio of $Weight_{backingplateresin}$:$Weight_{flapdisc}$ can be from about 1:500 to about 1:7, such as about 1:400 to about 1:8, or about 1:300 to about 1:9.

In an embodiment, the wearable backing plate can comprise a beneficial ratio of the total weight of the wearable backing plate ($Weight_{backingplate}$) to a total weight of the flap disc ($Weight_{flapdisc}$). In an embodiment, the ratio of $Weight_{backingplate}$:$Weight_{flapdisc}$ is not more than 1:1, such as about 1:1.1, about 1:1.2, or about 1:1.3. In an embodiment, $Weight_{backingplateresin}$:$Weight_{flapdisc}$ is at least 1:100, such as about 1:75, about 1:50, about 1:25, or about 1:10

In an embodiment, the wearable backing plate can comprise a beneficial ratio of the total weight of wearable backing plate ($Weight_{backingplate}$) to a total weight of the flap disc ($Weight_{flapdisc}$). In an embodiment, the ratio of $Weight_{backingplate}$:$Weight_{flapdisc}$ is not less than 1:100, such as about 1:75, about 1:50, about 1:25, or about 1:10. In an embodiment, $Weight_{backingplate}$:$Weight_{flapdisc}$ is at least 1:0.9, such as about 1:1, about 1:1.1, about 1:1.2, or about 1:1.3. The ratio can be within a range comprising any pair of the previous upper and lower limits. In an embodiment, the ratio of $Weight_{backingplate}$:$Weight_{flapdisc}$ can be from about 1:100 to about 1:1.

The wearable abrasive flap disc can beneficially exhibit a low rate of increase of the specific grinding energy (SGE) when the wearable backing plate comes in grinding contact with a workpiece compared to when the wearable backing plate is not in contact with the workpiece. In an embodiment, the low rate increase of SGE can be measured with respect to the cumulative wear of the workpiece. Qualitatively, such a low increases of the rate of SGE can be experienced as a minimal or no increase in the "shock" or "hard" handling of the wearable abrasive disc when the wearable backing plate comes in grinding contact with a workpiece compared to when the wearable backing plate is not in contact with the workpiece. In other words, an operator will not feel the difference in grinding force, or feel no need to apply more force to maintain the grinding action on the workpiece. In an alternate embodiment, the reduced increase in rate of SGE can be in comparison of when a wearable backing plate comes in grinding contact with a workpiece compared to when a conventional non wearable backing plate is in contact with the workpiece. In an embodiment, a rate of increase in SGE with respect to cumulative wear of a workpiece comparing a wearable flap disc to a conventional flap disc is not greater than about 30%, not greater than about 29%, not greater than about 28%, not greater than about 27%, not greater than about 26%, or not greater than about 25% when a wearable backing plate is in grinding contact with a workpiece as compared to when the backing plate is not in contact with the workpiece.

Coated Abrasive Flaps

The wearable abrasive flap disc comprises a plurality of coated abrasive flaps. In an embodiment, the coated abrasive flaps comprise an abrasive layer disposed on a backing material. Optionally, a size coat, a supersize coat, a back coat or any other number of compliant or intermediary layers known in the art of making a coated abrasive flap can be applied to construct a coated abrasive flap.

Abrasive Layer

An abrasive layer can comprise a make coat or an abrasive slurry. The make coat or abrasive slurry can comprise a plurality of abrasive particles, also referred to herein as abrasive grains, retained by a polymer binder composition. The polymer binder composition can be an aqueous composition. The polymer binder composition can be a thermosetting composition, a radiation cured composition, or a combination thereof.

Abrasive Grains

Abrasive grains can include essentially single phase inorganic materials, such as alumina, silicon carbide, silica, ceria, and harder, high performance superabrasive grains such as cubic boron nitride and diamond. Additionally, the abrasive grains can include composite particulate materials. Such materials can include aggregates, which can be formed through slurry processing pathways that include removal of the liquid carrier through volatilization or evaporation, leaving behind green aggregates, optionally followed by high temperature treatment (i.e., firing) to form usable, fired aggregates. Further, the abrasive regions can include engineered abrasives including macrostructures and particular three-dimensional structures.

In an exemplary embodiment, the abrasive grains are blended with the binder formulation to form abrasive slurry. Alternatively, the abrasive grains are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive grains can be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive grains comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

In an embodiment, the abrasive grains can have an average grain size not greater than 800 microns, such as not greater than about 700 microns, not greater than 500 microns, not greater than 200 microns, or not greater than 100 microns. In another embodiment, the abrasive grain size is at least 0.1 microns, at least 0.25 microns, or at least 0.5 microns. In another embodiment, the abrasive grains size is from about 0.1 microns to about 200 microns and more typically from about 0.1 microns to about 150 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

Binder—Make Coat or Abrasive "Slurry" Coat

The binder of the make coat or the size coat can be formed of a single polymer or a blend of polymers. For example, the binder can be formed from epoxy, acrylic polymer, or a combination thereof. In addition, the binder can include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder can be a nanocomposite binder including sub-micron particulate filler.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

Size Coat

The coated abrasive article can comprise a size coat overlying the abrasive layer. The size coat can be the same as or different from the polymer binder composition used to form the abrasive layer. The size coat can comprise any conventional compositions known in the art that can be used as a size coat. In an embodiment, the size coat comprises a conventionally known composition overlying the polymer binder composition of the abrasive layer. In another embodiment, the size coat comprises the same ingredients as the polymer binder composition of the abrasive layer. In a specific embodiment, the size coat comprises the same ingredients as the polymer binder composition of the abrasive layer and one or more hydrophobic additives. In a specific embodiment, the hydrophobic additive can be a wax, a halogenated organic compound, a halogen salt, a metal, or a metal alloy.

Supersize Coat

The coated abrasive article can comprise a supersize coat overlying the size coat. The supersize coat can be the same as or different from the polymer binder composition or the size coat composition. The supersize coat can comprise any conventional compositions known in the art that can be used as a supersize coat. In an embodiment, the supersize coat comprises a conventionally known composition overlying the size coat composition. In another embodiment, the supersize coat comprises the same ingredients as at least one of the size coat composition or the polymer binder composition of the abrasive layer. In a specific embodiment, the supersize coat comprises the same composition as the polymer binder composition of the abrasive layer or the composition of the size coat plus one or more grinding aids.

Suitable grinding aids can be inorganic based; such as halide salts, for example sodium cryolite, and potassium tetrafluoroborate; or organic based, such as sodium lauryl sulphate, or chlorinated waxes, such as polyvinyl chloride. In an embodiment, the grinding aid can be an environmentally sustainable material.

Additives

Any of the various polymeric compositions used to form the compressed composite backing material; namely the polymeric composition (dip fill), and the component layers of the coated abrasive article; namely the binder (as a make coat or "slurry" coat), the size coat composition, and the supersize composition can comprise one or more additives.

Suitable additives can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives may be present in any part of the overall system of the coated abrasive product according to embodiments of the present disclosure.

EMBODIMENTS

Embodiment 1

An abrasive flap disc comprising:

a wearable backing plate; and a plurality of abrasive flaps concentrically disposed about a periphery of the wearable backing plate.

Embodiment 2

The abrasive flap disc of embodiment 1, wherein the wearable backing plate comprises:

a first wearable polymeric layer;

a first reinforcing layer, and a second reinforcing layer, wherein the first wearable polymeric layer is disposed between the first reinforcing layer and the second reinforcing layer.

Embodiment 3

The abrasive flap disc of embodiment 2, wherein the wearable backing plate further comprises:

a second wearable polymeric layer disposed on the second reinforcing layer, and a third reinforcing layer disposed on the second wearable polymeric layer.

Embodiment 4

The abrasive flap disc of embodiment 3, wherein the wearable backing plate further comprises:

a third wearable polymeric layer disposed on the third reinforcing layer, and a fourth reinforcing layer disposed on the third wearable polymeric layer.

Embodiment 5

The abrasive flap disc of embodiment 2, wherein the first wearable polymeric layer comprises:

a polymeric resin, and abrasive particles, nonabrasive particles, filler particles, or a combination thereof dispersed in the polymeric resin.

Embodiment 6

The abrasive flap disc of embodiment 5, wherein the abrasive particles comprise a Mohs hardness of 9 or more.

Embodiment 7

The abrasive particles of embodiment 5, wherein the abrasive particles comprise one of alumina, zirconia, silicon carbide, silicon nitride, boron nitride, diamond, co-fused alumina zirconia, titanium diboride, boron carbide, alumina nitride, a combination thereof, or a blend thereof.

Embodiment 8

The abrasive flap disc of embodiment 5, wherein the nonabrasive particles comprise a Mohs hardness of less than 9.

Embodiment 9

The abrasive flap disc of embodiment 5, wherein the nonabrasive particles comprise one of lithium, talc, graphite, gypsum, calcite, fluorite, copper, tin, iron, nickel, zirconium, quartz, silica, ceria, flint, emery, garnet, a combination thereof, or a blend thereof.

Embodiment 10

The abrasive flap disc of embodiment 5, wherein the filler particles comprise one of cryolite, lithopone, iron pyrite, calcium carbonate, sodium carbonate, aluminum fluoride, iron oxide, barium sulfate, calcium sulfate, aluminum sulfate, calcium inosilicate ($CaSiO_3$, a.k.a., wollastonite), cenosphere, clay, polymer modified clay, a combination thereof, or a blend thereof.

Embodiment 11

The abrasive flap disc of embodiment 5, wherein the polymeric resin comprises a phenolic polymeric composition.

Embodiment 12

The abrasive flap disc of embodiment 11, wherein the phenolic polymer composition comprises a blend of a novolac resin and a resole resin.

Embodiment 13

The abrasive flap disc of embodiment 2, wherein the first wearable polymeric layer comprises:

1 to 30 wt % polymeric resin.

Embodiment 14

The abrasive flap disc of embodiment 2, wherein the first wearable polymeric layer comprises:

50 to 95 wt % abrasive particles.

Embodiment 15

The abrasive flap disc of embodiment 2, wherein the first wearable polymeric layer comprises:

50 to 95 wt % nonabrasive particles.

Embodiment 16

The abrasive flap disc of embodiment 2, wherein the first polymeric layer comprises:

0 to 70 wt % filler particles.

Embodiment 17

The abrasive flap disc of embodiment 2, wherein the first reinforcing layer comprises a fabric.

Embodiment 18

The abrasive flap disc of embodiment 17, wherein the fabric is a woven fabric, a nonwoven fabric, a mesh, or a combination thereof.

Embodiment 19

The abrasive flap disc of embodiment 17, wherein the fabric comprises organic fibers, inorganic fibers, or a combination thereof.

Embodiment 20

The abrasive flap disc of embodiment 19, wherein the organic fibers comprise natural fibers, synthetic fibers, a mixture of natural fibers, a mixtures of synthetic fibers, or a mixture of a natural and a synthetic fibers.

Embodiment 21

The abrasive flap disc of embodiment 20, wherein the natural fibers comprise cellulose fibers, cotton fibers, sisal fibers, hemp fibers, jute fibers, banana fibers, bamboo fibers, coconut fibers, paper fibers, or combinations thereof.

Embodiment 22

The abrasive flap disc of embodiment 20, wherein the synthetic fibers comprise polyester fibers (e.g., polyethylene terephthalate), nylon fibers (e.g., hexamethylene adipamide, polycaprolactam), polypropylene fibers, acrylonitrile fibers (i.e., acrylic), rayon fibers, cellulose acetate fibers, polyvinylidene chloride-vinyl chloride copolymer fibers, or vinyl chloride-acrylonitrile copolymer fibers.

Embodiment 23

The abrasive flap disc of embodiment 19, wherein the inorganic fibers comprise glass fibers, metal fibers, ceramic fibers, cermet fibers, or a combination thereof.

Embodiment 24

The abrasive flap disc of embodiment 17, wherein the fabric is impregnated with a polymeric composition.

Embodiment 25

The abrasive flap disc of embodiment 17, wherein the fabric comprises a mesh density of at least 4×4 to not greater than 13×13.

Embodiment 26

The abrasive flap disc of embodiment 2, wherein the second reinforcing layer is the same as the first reinforcing layer.

Embodiment 27

The abrasive flap disc of embodiment 2, wherein the second reinforcing layer is different than the first reinforcing layer.

Embodiment 28

The abrasive flap disc of embodiment 3, wherein the third reinforcing layer is the same as the first reinforcing layer or the second reinforcing layer.

Embodiment 29

The abrasive flap disc of embodiment 3, wherein the third reinforcing layer is different than the first reinforcing layer or the second reinforcing layer.

Embodiment 30

The abrasive flap disc of embodiment 3, wherein the second wearable polymeric layer is the same as the second wearable polymeric layer.

Embodiment 31

The abrasive flap disc of embodiment 3, wherein the second wearable polymeric layer is different than the second wearable polymeric layer.

Embodiment 32

The abrasive flap disc of embodiment 4, wherein the fourth reinforcing layer is the same as the first reinforcing layer, the second reinforcing layer, or the third reinforcing layer.

Embodiment 33

The abrasive flap disc of embodiment 4, wherein the fourth reinforcing layer is different than the first reinforcing layer, the second reinforcing layer, or the third reinforcing layer.

Embodiment 34

The abrasive flap disc of embodiment 4, wherein the third wearable polymeric layer is the same as the first wearable polymeric layer or the second wearable polymeric layer.

Embodiment 35

The abrasive flap disc of embodiment 4, wherein the third wearable polymeric layer is different than the first wearable polymeric layer or the second wearable polymeric layer.

Embodiment 36

The abrasive flap disc of embodiment 1, comprising an overall vol % of abrasive, a vol % of bond, a vol % of porosity, or a combination thereof.

Embodiment 37

The abrasive flap disc of embodiment 36, comprising:
35 to 70 vol % abrasive

Embodiment 38

The abrasive flap disc of embodiment 36, comprising:
1 to 60 vol % bond

Embodiment 39

The abrasive flap disc of embodiment 36, comprising:
0 to 55 vol % porosity

Embodiment 40

The abrasive flap disc of embodiment 1, comprising a minimum burst speed of at least 15,000 rpm to not greater than 30,000 rpm.

Embodiment 41

The abrasive flap disc of embodiment 1, comprising a flexural stiffness of at least 760 MPa.

Embodiment 42

The abrasive flap disc of embodiment 1, comprising a flexural strength of at least 200 N.

Embodiment 43

The abrasive flap disc of embodiment 1, comprising a ratio of the weight of the polymeric resin of the wearable backing plate ($Weight_{backingplateresin}$) to a total weight of the flap disc ($Weight_{flapdisc}$) in a range of 1:7 to 1:500.

Embodiment 44

The abrasive flap disc of embodiment 1, comprising a ratio of a total weight of the wearable backing plate ($Weight_{backingplate}$) to a total weight ($Weight_{flapdisc}$) of the flap disc in a range of 1:1.2 to 1:100.

Embodiment 45

The abrasive flap disc of embodiment 1, comprising a rate of increase in specific grinding energy with respect to cumulative wear of not greater than 25% as compared to a non-wearable backing plate when the wearable backing plate is in grinding contact with a workpiece compared to when the backing plate is not in contact with the workpiece.

Embodiment 46

A method of making a wearable polymeric backing plate comprising:
mixing together a polymeric resin and abrasive particles, nonabrasive particles, filler particles, or a combination thereof to form a precursor composition;
disposing a first fiber reinforcement layer into a mold;
disposing a portion of the precursor composition over the first fiber reinforcement layer in the mold;
disposing a second fiber reinforcement layer over the precursor composition in the mold;
pressing the mold; and
curing the precursor composition to form the wearable polymeric backing plate.

Embodiment 47

A method of making an abrasive flap disc comprising:
disposing a plurality of abrasive flaps concentrically about a periphery of a wearable polymeric backing plate,
wherein the wearable backing plate comprises:
a first wearable polymeric layer;
a first reinforcing layer, and
a second reinforcing layer, and
wherein the first wearable polymeric layer is disposed between the first reinforcing layer and the second reinforcing layer.

Embodiment 48

An abrasive flap disc comprising:
a wearable backing plate; and
a plurality of abrasive flaps concentrically disposed about a periphery of the wearable backing plate,
wherein the wearable backing plate comprises
a first wearable polymeric layer;
a first reinforcing layer, and
a second reinforcing layer,
wherein the first wearable polymeric layer is disposed between the first reinforcing layer and the second reinforcing layer.

Embodiment 49

The abrasive flap disc of embodiment 48, wherein the wearable backing plate further comprises:
a second wearable polymeric layer disposed on the second reinforcing layer, and
a third reinforcing layer disposed on the second wearable polymeric layer.

Embodiment 50

The abrasive flap disc of embodiment 49, wherein the wearable backing plate further comprises:
a third wearable polymeric layer disposed on the third reinforcing layer, and
a fourth reinforcing layer disposed on the third wearable polymeric layer.

Embodiment 51

The abrasive flap disc of embodiment 48, wherein the first wearable polymeric layer comprises:
a polymeric resin, and
abrasive particles, nonabrasive particles, filler particles, or a combination thereof dispersed in the polymeric resin.

Embodiment 52

The abrasive flap disc of embodiment 51, wherein the abrasive particles comprise a Mohs hardness of 9 or more.

Embodiment 53

The abrasive particles of embodiment 52, wherein the abrasive particles comprise one of alumina, zirconia, silicon carbide, silicon nitride, boron nitride, diamond, co-fused alumina zirconia, titanium diboride, boron carbide, alumina nitride, a combination thereof, or a blend thereof.

Embodiment 54

The abrasive flap disc of embodiment 51, wherein the nonabrasive particles comprise a Mohs hardness of less than 9.

Embodiment 55

The abrasive flap disc of embodiment 54, wherein the nonabrasive particles comprise one of lithium, talc, graphite, gypsum, calcite, fluorite, copper, tin, iron, nickel, zirconium, quartz, silica, ceria, flint, emery, garnet, a combination thereof, or a blend thereof.

Embodiment 56

The abrasive flap disc of embodiment 51, wherein the filler particles comprise one of cryolite, lithopone, iron pyrite, calcium carbonate, sodium carbonate, aluminum fluoride, iron oxide, barium sulfate, calcium sulfate, aluminum sulfate, calcium inosilicate (CaSiO3, a.k.a., wollastonite), cenosphere, clay, polymer modified clay, a combination thereof, or a blend thereof.

Embodiment 57

The abrasive flap disc of embodiment 51, wherein the polymeric resin comprises a phenolic polymeric composition.

Embodiment 58

The abrasive flap disc of embodiment 57, wherein the phenolic polymer composition comprises a blend of a novolac resin and a resole resin.

Embodiment 59

The abrasive flap disc of embodiment 49, wherein the first wearable polymeric layer comprises:

1 to 30 wt % polymeric resin;
50 to 95 wt % abrasive particles;
50 to 95 wt % nonabrasive particles; and
0 to 70 wt % filler particles.

Embodiment 60

The abrasive flap disc of embodiment 48, wherein the first reinforcing layer comprises a fabric.

Embodiment 61

The abrasive flap disc of embodiment 60, wherein the fabric is a woven fabric, a nonwoven fabric, a mesh, or a combination thereof.

Embodiment 62

The abrasive flap disc of embodiment 60, wherein the fabric comprises organic fibers, inorganic fibers, or a combination thereof.

Embodiment 63

The abrasive flap disc of embodiment 62, wherein the inorganic fibers comprise glass fibers, metal fibers, ceramic fibers, cermet fibers, or a combination thereof.

Embodiment 64

The abrasive flap disc of embodiment 60, wherein the fabric is impregnated with a polymeric composition.

Embodiment 65

The abrasive flap disc of embodiment 48, comprising a minimum burst speed of at least 15,000 rpm to not greater than 30,000 rpm, a flexural stiffness of at least 760 MPa, and a flexural strength of at least 200 N.

Embodiment 66

The abrasive flap disc of embodiment 48, comprising a ratio of the weight of the polymeric resin of the wearable backing plate (Weightbackingplateresin) to a total weight of the flap disc (Weightflapdisc) in a range of 1:7 to 1:500.

Embodiment 67

The abrasive flap disc of embodiment 48, comprising a rate of increase in specific grinding energy with respect to cumulative wear of not greater than 25% as compared to a non-wearable backing plate when the wearable backing plate is in grinding contact with a workpiece compared to when the backing plate is not in contact with the workpiece.

EXAMPLES

Example 1: Wearable Backing Plate Bond Systems

Several samples of inventive wearable backing plates were obtained for making inventive abrasive flap disc articles. The wearable backing plates were obtained by first mixing together a polymeric resin, abrasive particles and/or nonabrasive particles, and/or filler particles to form a precursor wearable backing plate bond composition (also called herein a "bond" or "Bond System"). Six sample bond systems (BS-1 to BS-6) were prepared. The amounts of the polymeric resin, abrasive particles, nonabrasive particles, and/or filler particles for the sample bond system compositions are given below in Table 1. A trace amount of cast oil was added to each bond system as a molding aid.

TABLE 1

Wearable Backing Plate Bond Compositions

| | Bond System-1 (BS-1) wt % | Bond System-2 (BS-2) wt % | Bond System-3 (BS-3) wt % | Bond System-4 (BS-4) wt % | Bond System-5 (BS-5) wt % | Bond System-6 (BS-6) wt % |
|---|---|---|---|---|---|---|
| Aluminum Oxide[1] | 78.2 | 86.4 | 86.4 | 85.5 | — | — |
| Emery[2] | — | — | — | — | 81.0 | 67.3 |
| LR[3] | 5.1 | 2.2 | 2.2 | 2.3 | 2.2 | 3.2 |
| LFR[4] | 7.6 | 4.1 | — | 4.3 | 6.6 | 12.0 |
| SFR[5] | — | — | 4.1 | — | — | — |
| $CaCO_3$ | 8.9 | 7.2 | 7.2 | 7.6 | 10.0 | 17.3 |
| Cast Oil | 0.2 | 0.2 | 0.2 | 0.2 | 0.2 | 0.2 |
| | 100.0 | 100.0 | 100.0 | 100.0 | 100.0 | 100.0 |

[1]Black aluminum oxide, 60 grit
[2]Emery, 40 grit
[3]Liquid Resin, Resole, number avg. mol. wt. 200-400 (e.g., 214-223) and weight average mol. wt. 300-500 (e.g. 351-363)
[4]Long flow resin, Novolac, number avg. mol. wt. 600-1000 (e.g., 875-950) and weight average mol. wt. 2000-4000 (e.g. 2166-3309)
[5]Short flow resin, Novolac, number avg. mol. wt. >900 (e.g., >950) and weight average mol. wt. >3000 ( e.g.,. >3197)

Example 2—Method of Making a Wearable Backing Plate

Several samples of inventive wearable backing plates were made using the bond systems described above in Example 1. The wearable backing plate samples had varying amounts of total layers (e.g., 3-Layer, 5-layer, and 7-layer) and were made according to the following process embodiment.

a. Mixing together components of the Bond System to form a bond composition as described above in Example 1.
b. Aging the bond composition (e.g., 4-5 hr.). The aged bond composition can have a cake-like structure for powdered resin and filler pickup.
c. Sieving the bond composition. Sieving is optional, but can be beneficial to break up or remove agglomerated grains larger than a desired size.
d. Inserting a glass fiber disc (i.e., a first reinforcing layer, the bottom reinforcing layer) into a mold.
e. Disposing a portion (fraction) of the bond composition into the mold over the glass fiber disc to form an uncured wearable polymeric layer. The amount of bond composition can be divided up into a specific number of fractions based on the number of desired layers for the wearable backing plate. For instance, for a wearable backing plate having five total layers, i.e., three reinforcing layers and two wearable polymeric layers, the bond composition will be divided into two fractions.
f. Repeat steps d. and e. until the desired number of layers is present.
g. Inserting a glass fiber disc (top) into the mold over the uncured wearable polymeric layer;
h. Pressing the structure of stacked reinforcing layers and uncured wearable polymeric layers at a desired pressure to achieve a desired thickness.
i. Curing under pressure the uncured polymeric layers in mold to form a wearable backing plate.

Example 3—Wearable Backing Plates

Wearable backing plates were obtained using the method of making described above in Example 2. The sample wearable backing plates were tested and characterized according to the total number of layers, the total thickness of the wearable backing plate, an overall vol % of abrasive particles, an overall vol % of bond composition, and an overall vol % of porosity. The results are shown below in Table 2, Table 3, and Table 4.

TABLE 2

Wearable Backing Plates Having Three Layers

| Sample | Layers | Bond System | Total Thickness (mm) | Abrasive (vol %) | Bond (vol %) | Porosity (vol %) |
|---|---|---|---|---|---|---|
| S1 (FB3) | (Top) 2nd Glass Fiber Disc[1]<br>(Middle) Wearable Polymeric Layer<br>(Bottom) 1st Glass Fiber Disc[2] | BS-2 | 2.5 | 58 | 20 | 22 |
| S2 (FB4) | Same as S1 | BS-2 | 2.0 | 58 | 20 | 22 |
| S3 (FB5) | Same as S1 | BS-3 | 2.0 | 58 | 20 | 22 |
| S4 (FB6) | Same as S1 | BS-2 | 1.6 | 58 | 20 | 22 |
| S5 (FB7) | (Top) 2nd Glass Fiber Disc[3]<br>(Middle) Wearable Polymeric Layer<br>(Bottom) 1st Glass Fiber Disc[4] | BS-2 | 2.0 | 58 | 20 | 22 |
| S6 (FB8) | Same as S1 | BS-4 | 2.0 | 54 | 20 | 26 |
| S7 (FB9) | Same as S5 | BS-5 | 2.0 | 58 | 20 | 22 |

[1]98 × 17 P190 (6 × 6): 98 mm Outer Dia. × 17 mm Inner Dia; 190 gsm; mesh size 6 × 6; paper layer included
[2]98 × 17 NP190 (6 × 6): 98 mm Outer Dia. × 17 mm Inner Dia; 190 gsm; mesh size 6 × 6; no paper layer included
[3]98 × 17 P320 (5 × 5): 98 mm Outer Dia. × 17 mm Inner Dia; 320 gsm; mesh size 5 × 5; paper layer included
[4]98 × 17 NP320 (5 × 5): 98 mm Outer Dia. × 17 mm Inner Dia; 320 gsm; mesh size 5 × 5; no paper layer included

TABLE 3

Wearable Backing Plates Having Five Layers

| Sample | Layers | Bond System | Total Thickness (mm) | Abrasive (vol %) | Bond (vol %) | Porosity (vol %) |
|---|---|---|---|---|---|---|
| S8 (FB15) | (Top) 3rd Glass Fiber Disc[1]<br>2nd Wearable Polymeric Layer<br>2nd Glass Fiber Disc[2]<br>1st Wearable Polymeric Layer<br>(Bottom) 1st Glass Fiber Disc[3] | BS-2 | 2.4 | 58 | 20 | 22 |
| S9 (FB16) | (Top) 3rd Glass Fiber Disc[4]<br>2nd Wearable Polymeric Layer<br>2nd Glass Fiber Disc[5]<br>1st Wearable Polymeric Layer<br>(Bottom) 1st Glass Fiber Disc[6] | BS-2 | 2.4 | 58 | 20 | 22 |

TABLE 3-continued

| Wearable Backing Plates Having Five Layers | | | | | | |
|---|---|---|---|---|---|---|
| Sample | Layers | Bond System | Total Thickness (mm) | Abrasive (vol %) | Bond (vol %) | Porosity (vol %) |
| S10 (FB21) | Same as S8 | BS-5 | 2.3 | 58 | 20 | 22 |
| S11 (FB22) | Same as S9 | BS-5 | 2.3 | 58 | 20 | 22 |

[1]98 × 17 P320 (5 × 5): 98 mm Outer Dia. × 17 mm Inner Dia; 320 gsm; mesh size 5 × 5; paper layer included
[2]95 × 17 NP320 (5 × 5): 95 mm Outer Dia. × 17 mm Inner Dia; 320 gsm; mesh size 5 × 5; no paper layer included
[3]98 × 17 NP320 (5 × 5): 98 mm Outer Dia. × 17 mm Inner Dia; 320 gsm; mesh size 5 × 5; no paper layer included
[4]98 × 17 P320 (8 × 8): 98 mm Outer Dia. × 17 mm Inner Dia; 320 gsm; mesh size 8 × 8; paper layer included
[5]95 × 17 NP320 (5 × 5): 95 mm Outer Dia. × 17 mm Inner Dia; 320 gsm; mesh size 5 × 5; no paper layer included
[6]98 × 17 NP320 (8 × 8): 98 mm Outer Dia. × 17 mm Inner Dia; 320 gsm; mesh size 8 × 8; no paper layer included

TABLE 4

| Wearable Backing Plates Having Seven Layers | | | | | | |
|---|---|---|---|---|---|---|
| Sample | Layers | Bond System | Total Thickness (mm) | Abrasive (vol %) | Bond (vol %) | Porosity (vol %) |
| S12 (FB17) | (Top) 4$^{th}$ Glass Fiber Disc[1]<br>3$^{rd}$ Wearable Polymeric Layer<br>3$^{rd}$ Glass Fiber Disc[2]<br>2$^{st}$ Wearable Polymeric Layer<br>2$^{nd}$ Glass Fiber Disc[3]<br>1$^{st}$ Wearable Polymeric Layer<br>(Bottom) 1$^{st}$ Glass Fiber Disc[4] | BS-2 | 3.2 | 58 | 20 | 22 |
| S13 (FB18) | (Top) 4$^{th}$ Glass Fiber Disc[5]<br>3$^{rd}$ Wearable Polymeric Layer<br>3$^{rd}$ Glass Fiber Disc[6]<br>2$^{nd}$ Wearable Polymeric Layer<br>2$^{nd}$ Glass Fiber Disc[7]<br>1$^{st}$ Wearable Polymeric Layer<br>(Bottom) 1$^{st}$ Glass Fiber Disc[8] | BS-2 | 3.2 | 58 | 20 | 22 |
| S14 (FB23) | Same as S12 | BS-6 | 3.0 | 50 | 36 | 14 |
| S15 (FB24) | Same as S13 | BS-6 | 3.0 | 50 | 36 | 14 |

[1]98 × 17 P320 (5 × 5): 98 mm Outer Dia. × 17 mm Inner Dia; 320 gsm; mesh size 5 × 5; paper layer included
[2]95 × 17 NP320 (5 × 5): 95 mm Outer Dia. × 17 mm Inner Dia; 320 gsm; mesh size 5 × 5; no paper layer included
[3]98 × 17 NP320 (5 × 5): 98 mm Outer Dia. × 17 mm Inner Dia; 320 gsm; mesh size 5 × 5; no paper layer included
[4]98 × 17 NP320 (5 × 5): 98 mm Outer Dia. × 17 mm Inner Dia; 320 gsm; mesh size 5 × 5; no paper layer included
[5]98 × 17 P320 (8 × 8): 98 mm Outer Dia. × 17 mm Inner Dia; 320 gsm; mesh size 8 × 8; paper layer included
[6]95 × 17 NP320 (5 × 5): 95 mm Outer Dia. × 17 mm Inner Dia; 320 gsm; mesh size 5 × 5; no paper layer included
[7]95 × 17 NP320 (5 × 5): 95 mm Outer Dia. × 17 mm Inner Dia; 320 gsm; mesh size 5 × 5; no paper layer included
[8]98 × 17 NP320 (8 × 8): 98 mm Outer Dia. × 17 mm Inner Dia; 320 gsm; mesh size 8 × 8; no paper layer included

Example 4—Method of Making an Abrasive Flap Disc

Several samples of inventive flap disc including wearable backing plates were made using the wearable backing plates described above in Example 3. The abrasive flap discs were made according to the following process embodiment.

a. Disposing an adhesive composition on a wearable polymeric backing plate.

b. Disposing a plurality of abrasive flaps concentrically about a periphery of the wearable polymeric backing plate.

Example 5—Abrasive Flap Disc Including a Wearable Backing Plate

Wearable backing plates were obtained using the method of making described above in Example 4. The abrasive flaps were comprised of a cloth backing (Polycotton blend—65% Cotton and 35% Polyester). The cloth backing was finished with a dip fill and back fill of phenolic resin and latex. A make coat (phenolic resin) was disposed on the cloth backing. Abrasive grains were disposed on the make coat. A size coat was disposed over the make coat and abrasive grains. The number of flaps disposed on the wearable polymeric backing plate was 72. The dimensions of the flaps were 22 mm×18 mm. The sample flap discs were tested for various physical characteristics and abrasive performance properties. The results are shown below in Table 5. An indication of "-" in the table below means that the variable was not measured for that sample.

TABLE 5

Wearable Backing Plates Having Three Layers

| Sample | No. Of Layers | Flap Disc Weight (g) | Avg. Burst Speed[1] (RPM) | SGE Increase[2] (Watt-Second/g) | Flexural strength[3] (N) | Decreased Operator Handling?[4] | Cum. MR[5] |
|---|---|---|---|---|---|---|---|
| S1 (FB3) | 3 | 83.4 | 19578 | 259 | n/a | no | 113.3 |
| S2 (FB4) | 3 | 71.9 | 19888 | 888 | n/a | no | 106.8 |
| S3 (FB5) | 3 | 81.8 | 20340 | — | 950 | no | — |
| S4 (FB6) | 3 | 73.6 | 18365 | — | 436 | no | — |
| S5 (FB7) | 3 | 78.1 | 22990 | — | 967 | no | — |
| S6 (FB8) | 3 | 78.4 | 20806 | — | 963 | no | — |
| S7 (FB9) | 3 | 70.1 | 21704 | — | 966 | no | — |
| S8 (FB15) | 5 | 72.5 | 25500 | 900 | n/a | no | 72.95 |
| S9 (FB16) | 5 | 70.6 | 22034 | 900 | n/a | no | 64.2 |
| S10 (FB21) | 5 | 73.0 | 20376 | — | n/a | no | 31 |
| S11 (FB22) | 5 | 73.0 | 21098 | — | n/a | no | 36.7 |
| S12 (FB17) | 7 | 81.3 | 21641 | 700 | n/a | no | 60.75 |
| S13 (FB18) | 7 | 78.5 | 24989 | 800 | n/a | no | 54.6 |
| S14 (FB23) | 7 | 69.8 | 22329 | 900 | n/a | no | 35.4 |
| S15 (FB24) | 7 | 84.9 | 23647 | 900 | n/a | no | 48.5 |

[1]Average of at least two tests.

[2]The increase in specific grinding energy (SGE) when the wearable polymeric backing plate is in contact with the workpiece during grinding (i.e., after a portion of the abrasive flap has been worn through).

[3]Maximum load before breaking.

[4]Did the operator notice an increase in difficulty of handling (i.e., an increase in the "hardness") of the grinding tool when the flaps were worn through and the wearable backing plate came into contact with the work piece during grinding?

[5]Cumulative material removal during hand held angle grinding on a carbon steel workpiece.

(i) Grinding condition: RPM of the spindle 11000 and grinding angle is 20-45°.

(ii) End point of the grinding test is (a) all flaps worn out and (b) material removal rate is lower than 5 g/min.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive flap disc comprising:

a wearable backing plate; and a plurality of abrasive flaps concentrically disposed about a periphery of the wearable backing plate, wherein the wearable backing plate comprises:

a first wearable polymeric layer;

a first reinforcing layer; and a second reinforcing layer, wherein the first wearable polymeric layer is disposed between the first reinforcing layer and the second reinforcing layer;

wherein the abrasive flap disc comprises a minimum burst speed of at least 15,000 rpm to not greater than 30,000 rpm, a flexural stiffness of at least 760 MPa, and a flexural strength of at least 200 N.

2. An abrasive flap disc comprising:
a wearable backing plate; and
a plurality of abrasive flaps concentrically disposed about a periphery of the wearable backing plate, wherein the wearable backing plate comprises:
a first wearable polymeric layer;
a first reinforcing layer;
a second reinforcing layer, wherein the first wearable polymeric layer is disposed between the first reinforcing layer and the second reinforcing layer;
a second wearable polymeric layer disposed on the second reinforcing layer; and
a third reinforcing layer disposed on the second wearable polymeric layer;
wherein the first wearable polymeric layer comprises:
1 to 30 wt % polymeric resin;
50 to 95 wt % abrasive particles;
45 to 95 wt % nonabrasive particles; and
0 to 70 wt % filler particles.

3. The abrasive flap disc of claim 2, wherein the wearable backing plate further comprises:
a third wearable polymeric layer disposed on the third reinforcing layer, and
a fourth reinforcing layer disposed on the third wearable polymeric layer.

4. An abrasive flap disc comprising:
a wearable backing plate; and
a plurality of abrasive flaps concentrically disposed about a periphery of the wearable backing plate, wherein the wearable backing plate comprises:
a first wearable polymeric layer, wherein the first wearable polymeric layer comprises a polymeric resin, wherein the polymeric resin comprises a phenolic polymeric composition comprising a blend of a novolac resin and a resole resin, and abrasive particles, nonabrasive particles, filler particles, or a combination thereof dispersed in the polymeric resin;
a first reinforcing layer; and
a second reinforcing layer, wherein the first wearable polymeric layer is disposed between the first reinforcing layer and the second reinforcing layer.

5. The abrasive flap disc of claim 4, wherein the abrasive particles comprise a Mohs hardness of 9 or more.

6. The abrasive particles of claim 5, wherein the abrasive particles comprise one of alumina, zirconia, silicon carbide, silicon nitride, boron nitride, diamond, co-fused alumina zirconia, titanium diboride, boron carbide, alumina nitride, a combination thereof, or a blend thereof.

7. The abrasive flap disc of claim 4, wherein the nonabrasive particles comprise a Mohs hardness of less than 9.

8. The abrasive flap disc of claim 4, wherein the filler particles comprise one of cryolite, lithopone, iron pyrite, calcium carbonate, sodium carbonate, aluminum fluoride, iron oxide, barium sulfate, calcium sulfate, aluminum sulfate, calcium inosilicate (CaSiO3, a.k.a., wollastonite), cenosphere, clay, polymer modified clay, a combination thereof, or a blend thereof.

9. The abrasive flap disc of claim 1, wherein the first reinforcing layer comprises a fabric.

10. The abrasive flap disc of claim 9, wherein the fabric is a woven fabric, a nonwoven fabric, a mesh, or a combination thereof.

11. The abrasive flap disc of claim 9, wherein the fabric comprises organic fibers, inorganic fibers, or a combination thereof.

12. The abrasive flap disc of claim 11, wherein the inorganic fibers comprise glass fibers, metal fibers, ceramic fibers, cermet fibers, or a combination thereof.

13. The abrasive flap disc of claim 9, wherein the fabric is impregnated with a polymeric composition.

14. The abrasive flap disc of claim 1, comprising a ratio of the weight of the polymeric resin of the wearable backing plate ($Weight_{backingplateresin}$) to a total weight of the flap disc ($Weight_{flapdisc}$) in a range of 1:7 to 1:500.

15. The abrasive flap disc of claim 1, comprising a rate of increase in specific grinding energy with respect to cumulative wear of not greater than 25% as compared to a conventional flap disc when the wearable backing plate is in grinding contact with a workpiece compared to when the backing plate is not in contact with the workpiece.

16. The abrasive flap disc of claim 2, wherein the first reinforcing layer comprises a woven fabric, a nonwoven fabric, a mesh, or a combination thereof.

17. The abrasive flap disc of claim 16, wherein the woven fabric, the nonwoven fabric, the mesh, or the combination thereof is impregnated with a polymeric composition.

18. The abrasive flap disc of claim 4, wherein the first reinforcing layer comprises a woven fabric, a nonwoven fabric, a mesh, or a combination thereof.

19. The abrasive flap disc of claim 18, wherein the woven fabric, the nonwoven fabric, the mesh, or the combination thereof is impregnated with a polymeric composition.

* * * * *